US006671231B2

(12) United States Patent
Gilomen

(10) Patent No.: US 6,671,231 B2
(45) Date of Patent: Dec. 30, 2003

(54) SEQUENTIAL CONTROL METHOD FOR A DISPLAY ASSEMBLY INCLUDING TWO SUPERPOSED DISPLAY DEVICES

(75) Inventor: Beat Gilomen, Grenchen (CH)

(73) Assignee: ETA SA Fabriques d'Ebauches, Grenchen (CH)

( * ) Notice: Subject to any disclaimer, the term of this patent is extended or adjusted under 35 U.S.C. 154(b) by 71 days.

(21) Appl. No.: 09/988,281

(22) Filed: Nov. 19, 2001

(65) Prior Publication Data

US 2002/0071347 A1 Jun. 13, 2002

(30) Foreign Application Priority Data

Dec. 11, 2000 (CH) ..... 2406/00

(51) Int. Cl.[7] ..... G04B 19/04; G04C 19/00; G04C 17/00

(52) U.S. Cl. ..... 368/80; 368/82; 368/223; 368/239; 368/242

(58) Field of Search ..... 368/80, 82, 84, 368/223, 239, 242

(56) References Cited

U.S. PATENT DOCUMENTS 5,455,808 A 10/1995 Grupp et al.
5,740,130 A * 4/1998 Grupp et al. ..... 368/82
5,995,456 A 11/1999 Brewer et al.
6,515,942 B2 * 2/2003 Basturk ..... 368/223

FOREIGN PATENT DOCUMENTS

| | | |
|---|---|---|
| EP | 539 333 | 4/1993 |
| EP | 927 917 | 7/1999 |
| EP | 939 331 | 9/1999 |

* cited by examiner

*Primary Examiner*—Vit Miska
(74) *Attorney, Agent, or Firm*—Sughrue Mion, PLLC

(57) ABSTRACT

A sequential control method for a display assembly including two superposed, respectively top (22; 46) and bottom (24; 48), display devices, the top display device (22; 46) including at least a liquid crystal display cell (26, 28; 50) and being arranged so as to be transparent in a first state to make the bottom display device (24; 48) visible, and so as to display a data item and to be opaque and reflective and to mask at least partially the bottom display device (24; 48) in a second state, control means supplying a control voltage to cause the top display device (22; 46) to pass from the first state to the second state and vice versa, characterised in that the display assembly is made to enter an operating state in which the top display device (22; 46) automatically switches into the state in which it is transparent or into the state in which it is opaque and reflective, so that the display assembly passes alternately from a mode displaying data via the top display device (22; 46) to a mode displaying data via the bottom display device (24; 48).

2 Claims, 4 Drawing Sheets

SEQUENTIAL CONTROL METHOD FOR A DISPLAY ASSEMBLY INCLUDING TWO SUPERPOSED DISPLAY DEVICES

BACKGROUND OF THE INVENTION

The present invention concerns a sequential control method for a display assembly including two superposed, respectively top and bottom, display devices, and more particularly a control method for a timepiece including a display assembly of the aforementioned type wherein an analogue display assembly is combined with a digital display assembly.

A so-called analogue-digital watch including a combination of analogue and digital display means is already known from European Patent No. 0 078 237 in the name of the Applicant. More precisely, this watch includes analogue time display means including an hour hand and a minute hand. These hour and minute hands are arranged above a liquid crystal display cell which forms a dial for said hands. The cell includes a hole located substantially at its centre, through which a first shaft, onto which the hour hand is fixed and a second shaft onto which the minute hand is fixed, pass. A control circuit applies a control signal across the terminals of liquid crystal display cell so that this cell displays an item of data selected from several types of data, across the terminals of the liquid crystal display cell. It may be, for example, time-related data such as the time, the minute and the second. It may also be date-related data, measured time or other data.

Other types of electronic watches including a case inside which are arranged both an analogue display device and a digital display device are also known. This is the case, for example, of a watch having a conventional analogue display device including hands moving above a dial, and a digital display device such as a liquid crystal cell arranged under the dial and visible through an aperture made in said dial.

A new type of analogue-digital watch has recently appeared. Such a watch includes a display assembly formed by an analogue display device and a digital display device. The analogue display device includes hour, minute and second hands which move above a dial, while the digital display device includes a liquid crystal display cell arranged in front of the analogue display device which it completely covers.

When the digital display device is switched into the state in which it is transparent, the data displayed by the analogue display device is perfectly visible. If, however, one chooses to use the top display device, the latter is then switched into the state in which it is opaque and reflective to totally mask the bottom display device.

Thus, when no data is displayed by the digital display device, the watch has the appearance of a conventional analogue device, i.e. the hands and the dial are completely visible through the digital display device which is transparent. Conversely, when data is displayed by the digital display device, the watch has the appearance of a purely digital watch. i.e. the hands and the dial of the analogue display device are totally masked by the digital display device and only the data displayed by the latter is visible.

It is thus possible to use either the bottom display device, or the top display device selectively, without one altering the quality and legibility of the data displayed by the other. This constitutes real progress with respect to the analogue-digital watches known to date which simultaneously display analogue data and digital data, consequently making it difficult to read such data, and this is all the more so the greater the density of data displayed.

Unfortunately, in the places where these new analogue-digital watches are exhibited in order to be marketed (for example in the window of a retail outlet), there is nothing to distinguish them from conventional analogue watches or digital watches. Indeed, either the top display cell is switched into the state in which it is transparent and in which the dial and the hands of the bottom display device are perfectly visible, and in this case the watch has the appearance of a conventional analogue watch, or the top display cell is switched into the state in which it is opaque and reflective and displays data, and in this case the bottom analogue display device is masked and the watch has a purely digital appearance. Consequently, at first sight there is nothing to enable a potential purchaser or passer-by who may pass in front of the window of the retail outlet to distinguish the analogue-digital watches of the type described above from the purely analogue or purely digital watches and fully appreciate the originality of these new products.

SUMMARY OF THE INVENTION

The object of the present invention is thus to overcome the aforementioned drawbacks, in addition to others by proposing a control method for an analogue-digital watch of the type defined above which allows a potential purchaser to distinguish such a watch from existing analogue or digital watches at a single glance.

The present invention therefore concerns a sequential control method for a display assembly including two superposed, respectively top and bottom, display devices, the top display device including at least a liquid crystal display cell and being arranged so as to be transparent in a first state to make the bottom display device visible, and so as to display a data item and to be opaque and reflective and to mask at least partially the bottom display device in a second state, control means supplying a control voltage to cause the top display device to pass from the first state to the second state and vice versa, this method being characterised in that the display assembly is made to enter an operating state wherein the top display device automatically switches in the state in which it is transparent or into the state in which it is opaque and reflective, so that the display assembly passes alternately from a mode displaying data via the top display device to a mode displaying data via the bottom display device.

As a result of these features, a potential client's attention, stopped in front of the window of a retail outlet or in front of an exhibition stand, is drawn to the originality of the display devices including two superposed display devices by alternately switching the top display device into the state in which it is transparent or into the state in which it is opaque and reflective, so that the display assembly passes automatically from a first data display mode to a second data display mode different to the first. The passer-by's eye will thus be drawn by this phenomenon, which should make the passer-by interested in the product in question.

According to another feature, the present invention concerns a sequential control method for a display assembly formed by an analogue data display device and a digital display device arranged in front of the analogue data display device which it covers at least partially, this method being characterised in that the display assembly is made to enter an operating mode in which the top display device automatically and alternately passes from an analogue data display mode to a digital data display mode.

Thus, when no data is displayed by the digital display device, the watch has the appearance of a conventional analogue watch. Conversely, when data is displayed by the digital display device, the watch has the appearance of a purely digital watch. Seeing the watch pass automatically from an analogue appearance to a digital appearance and vice versa, the potential purchaser immediately sees the difference which separates such a watch from conventional purely analogue or digital watches, and may fully appreciate all the advantages which this watch provides from the point of view of the originality of its design, its innovative aesthetic appearance, its ease of use and other advantages.

According to another feature of the invention, the top display device and the bottom display device are automatically and alternately activated at a frequency of the order of 0.5 Hz.

This frequency is sufficiently high for the flashing phenomenon to be immediately perceptible to the human eye, but nonetheless sufficiently slow for the human eye to be able to distinguish the details of the display in the analogue and digital modes respectively.

BRIEF DESCRIPTION OF THE DRAWINGS

Other features and advantages of the present invention will appear more clearly upon reading the following detailed description of an implementation example of the method according to the invention, this example being given purely by way of non-limiting illustration, in conjunction with the annexed drawings in which.

DETAILED DESCRIPTION OF THE INVENTION

The present invention proceeds from the general inventive idea consisting in controlling the automatic passage of an analogue-digital watch including an analogue display device for time-related data above which is arranged a digital data display device from an analogue display mode of time-related data to a digital display mode and vice versa. This phenomenon of switching on and off digital data giving way, at regular intervals of time, to an analogue display of time data is for the purpose of attracting the attention of the potential client, who passes, for example, in front of the window of a retail outlet, and interesting him in the product in question allowing him to establish immediately the distinction between this type of product and watches which are either exclusively digital or exclusively analogue, or which simultaneously display analogue and digital data.

The present invention will be described with reference to a timepiece such as a wristwatch. It goes without saying that the invention is not limited to this application and that it could advantageously be used within the scope of any other application requiring the display of data, such as, for example, measuring instruments.

Figure 1:
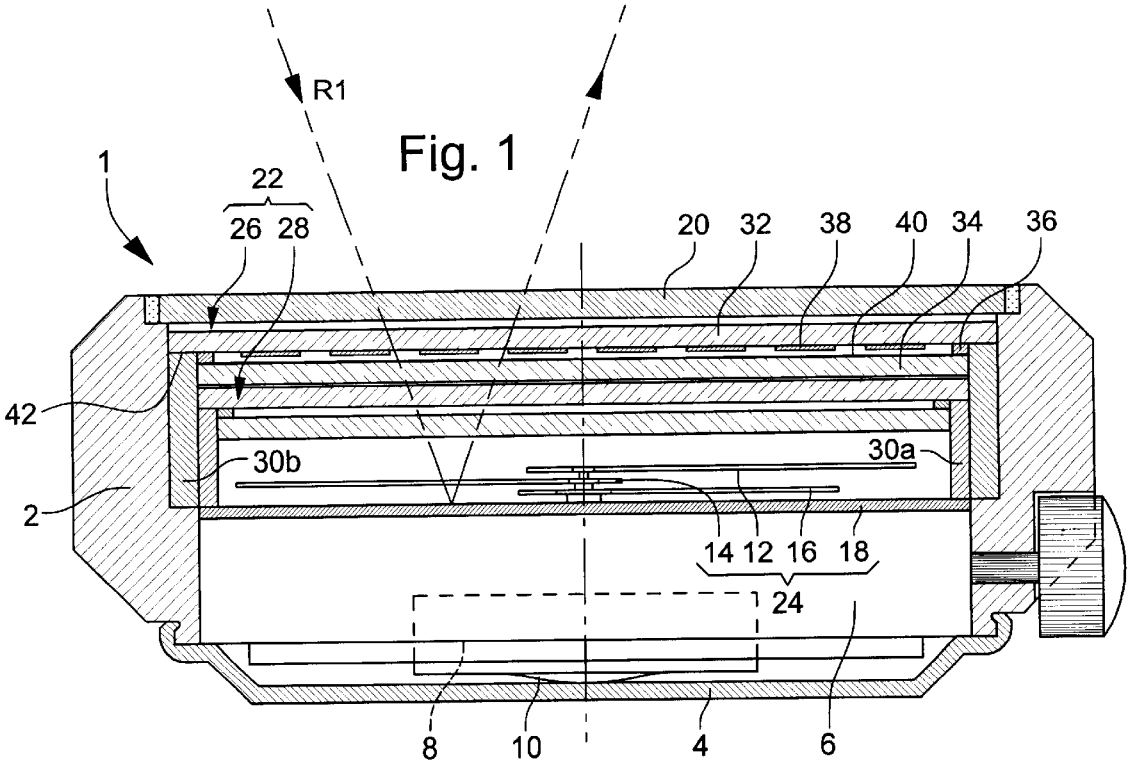
FIG. 1 is a cross-section of a wristwatch fitted with a display assembly including two superposed, respectively top and bottom, display devices, the top display device including a double structure formed of a digital display cell arranged above an optical valve, and the bottom display device including analogue time display means formed by a dial above which hands move.

With reference to FIG. 1, a timepiece of the wristwatch type designated as a whole by the reference numeral 1 can be seen. This watch 1 includes, in a conventional manner, a case 2 provided with a back cover 4 in which are arranged an electronic watch movement 6 and a battery 8 which rests on back cover 4 via a contact spring 10. Movement 6 includes electronic time-keeping circuits associated, via a control circuit, with a drive device (not shown) for a second hand 12, a minute hand 14 and an hour hand 16 which move above a dial 18. Case 2 is also closed in a conventional manner by a crystal 20 covering the whole of dial 18.

Watch 1 further includes a display assembly including two superposed, respectively top 22 and bottom 24, display devices. The display assembly which is fitted to watch 1 will only be described succinctly here as regards its main means. For a more detailed description of this display assembly, reference will advantageously be made to European Patent Application No. 0 926 574 in the name of the Applicant.

In the example shown in FIG. 1, bottom display device 24 includes time-related display means, in particular analogue time display means formed by hands 12, 14, 16 and dial 18.

It goes without saying that this bottom display device 24 could be formed by any digital display device, for example of the liquid crystal type. This bottom display device 24 could also include a combination of analogue and digital display means such as the combination disclosed in the aforecited European Patent No. B-0 078 237 in the name of the Applicant, or a decorative element, for example a picture, figure or other.

Top display device 22 includes a double structure formed of a display cell 26 arranged above an optical valve 28, this top display device 22 extending between bottom display device 24 and crystal 20. In the example shown, this top display device 22 covers the whole of the surface of dial 18.

Top display device 22 is arranged on the one hand so that display cell 26, arranged between crystal 20 and optical valve 28, and the latter are transparent in a first switching state of cell 26 and valve 28, so as to make the data displayed by bottom display device 24 visible, namely hands 12, 14 and 16 and dial 18 in the example shown.

On the other hand, top display device 22 is arranged so that display cell 26 display a data item, for example of the alphanumerical type, and so that optical valve 28 is opaque and masks at least partially bottom display device 24 in a second switching state.

The switching of display cell 26 and optical valve 28 from the first state to the second state and vice versa is achieved by control means integrated in movement 6, these control means being connected to cell 26 and valve 28 by means of conventional connectors 30*a*, 30*b* to supply them with a control voltage.

According to a particular embodiment, cell 26 is a liquid crystal type display cell. The cell includes a transparent front substrate 32, a transparent back substrate 34, a sealing frame 36 forming spacing and closing means and delimiting with substrates 32 and 34 a closed cavity in which there is a layer of liquid crystals. The opposite faces of substrates 32 and 34 include transparent electrodes 38, 40, made for example of indium/tin oxide. In the example illustrated, front substrate 32 carries electrodes configured in digits each formed of segments allowing alphanumerical characters to be displayed, while back substrate 34 carries an electrode extending over its entire surface. Electrodes 38 and 40 are connected to connector 30*a* via contact pads 42 located outside the cavity.

When a voltage is applied or removed across electrode 40 and certain of electrodes 38, the liquid crystals between these electrodes 38, 40 are alternately passed from an absorbent state to a transparent state or vice versa, depending on the type of liquid crystals in question and/or the presence and arrangement of polarisers associated with the cell. It is thus possible to display data in a light colour on a dark background or dark data on a light background.

In the example shown, display cell 26 is a twisted nematic type liquid crystal cell whose respective external surfaces of substrates 32 and 34 are provided with polarisers (not shown) with crossed orientations. Thus, cell 26 is totally transparent, i.e. in the first switching state, when no voltage is applied across the terminals of its electrodes 38, 40 (non-switched state), and is absorbent or diffusing, i.e. in the second switching state, when a voltage is applied across the terminals of its electrodes 38, 40 (switched state).

It goes without saying that cell 26 may be of another type provided that in a first switching state, cell 26 is transparent, and that in a second switching state, cell 26 is absorbent or diffusing.

In the following description, elements identical to those described previously in conjunction with FIG. 1 will be designated by the same reference numerals.

Figure 2:
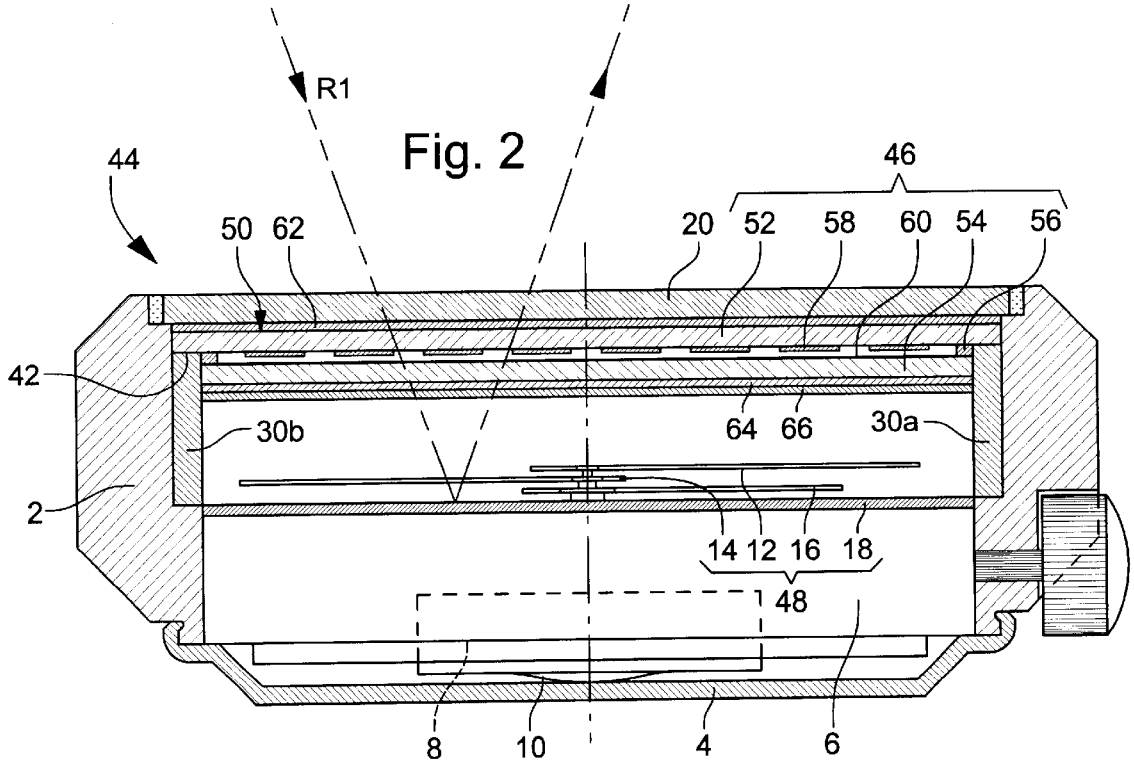
FIG. 2 is a cross-section of a wristwatch fitted with a display assembly including two superposed, respectively top and bottom, display devices the top digital display device including a cell arranged so as to be transparent in a first state, and diffusive or reflective in a second state, and the bottom display device including analogue time display means formed by a dial above which hands move.

With reference to FIG. 2, a timepiece of the wristwatch type is seen, designated as a whole by the general reference numeral 44. In a similar way to the timepiece previously described, this wristwatch 44 includes a case 2 provided with a back cover 4 occupied by an electronic watch movement 6 and a battery 8. Battery 8 rests on back cover 4 via a contact spring 10. Movement 6 is associated with a drive device (not shown) for a second hand 12, a minute hand 14 and an hour hand 16 which move above a dial 18. Case 2 is closed in a conventional manner by a crystal 20.

Watch 44 further includes a display assembly including two superposed, respectively top 46 and bottom 48, display devices. In the example shown, bottom display device 48 includes time-related display means, in particular analogue time display means, formed by hands 12, 14, 16 and dial 18.

It goes without saying that this bottom display device 48 could be formed by any digital display device, for example of the liquid crystal type. This display device 48 could also include a combination of analogue and digital display means such as the combination described in European Patent No. EP-B-0 078 237 in the name of the Applicant, or a decorative element, for example a picture, a drawing, etc.

The display device fitted to watch 44 will only be described succinctly here with respect to its main means. For a more detailed description of this display assembly, reference will advantageously be made to European Patent Application NO. 0 939 331 in the name of the Applicant.

According to the invention, top display device 46 includes a display cell 50 and extends between bottom display device 48 and crystal 20. In the example shown, this top display device 46 covers the whole of the surface of dial 18. It goes without saying that, according to an alternative embodiment, top display device 46 can form the crystal 20 of watch 44. Top display 44 is arranged so that display cell 50 is transparent in a first switching state to make the data displayed by bottom display device 48 visible, i.e. hands 12, 14, 16 and dial 18. On the other hand, top display device 46 is arranged so that display cell 50 displays a data item, for example of the alphanumerical type, in a second switching state.

Switching display cell 50 from the first state to the second state and vice versa is achieved by control means integrated in movement 6, these control means being connected to cell 50 via conventional connectors 30*a*, 30*b* to supply it with a control voltage.

Cell 50 is a liquid crystal display cell of the diffusing or reflective type in the second switching state.

According to a particular embodiment, cell 50 is a twisted nematic (TN) type liquid crystal cell. This cell 50 includes a transparent front substrate 52, a transparent back substrate 54, and a sealing frame 56 forming spacing and closing means and delimiting with substrates 52 and 54 a closed cavity in which there is a layer of liquid crystals. The opposite faces of substrates 52 and 54 include transparent electrodes 58, 60, made for example of indium/tin oxide. In the example illustrated, front substrate 52 carries electrodes 58 configured in digits each formed of segments allowing alphanumerical characters to be displayed, while back substrate 54 carries an electrode 60 extending over its entire surface. Electrodes 58 and 60 are connected to connector 30*a* via contact pads 42 located outside the cavity. Cell 50 further includes, on the side of crystal 20, a linear polariser 62 and, on the side of dial 18, a quarter-wave plate 64 associated with a cholesteric film 66.

It goes without saying that cell 50 may be of another type provided that in a first switching state, cell 50 is transparent, and that in a second switching state, cell 50 is opaque and reflective or diffusing.

One thus has a wristwatch 1 or 44 which includes a display assembly formed by an analogue display device and a digital display device. The analogue display device, respectively 24 or 48, includes a second hand 12, a minute hand 14 and an hour hand 16 which move above a dial 18, while the digital display device, respectively 22 or 46, includes a liquid crystal display cell, respectively 26 or 50, arranged in front of analogue display device 24 or 48 which it completely covers.

When digital display device 22 or 46 is switched into the state in which it is transparent, the data displayed by analogue display device 24 or 48 is perfectly visible. If however, one chooses to use top display device 22 or 46, the latter is then switched into the state in which it is opaque and reflective to totally mask the bottom display device.

Thus, when no data is displayed by the digital display device, the watch has the appearance of a conventional analogue watch, i.e. hands 12, 14 and 16 and dial 18 are completely visible through digital display device 22 or 46 which is transparent. Conversely, when data is displayed by digital display device 22 or 46, the watch has the appearance of a purely digital watch, i.e. hands 12, 14 and 16 and dial 18 of analogue display device 24 or 48 are totally masked by digital display device 22 or 46 and only the data displayed by the latter is visible.

Watch 1, 44 previously described, may thus have, as chosen, a purely digital appearance or a purely analogue appearance, which distinguishes it from watches which are only digital or only analogue, or even from watches which simultaneously display analogue and digital data.

However, at first sight, it is impossible to distinguish between a watch as described in the present Patent Application and a conventional watch which is purely analogue or purely digital. Means have therefore been sought to allow a potential purchaser or passer-by who stops, for example, in front of a the window of a retail outlet, to distinguish such a watch from existing analogue or digital watches at first glance.

Thus, according to the present invention, a sequential control method is proposed for a display assembly of the type described hereinbefore including a top display device, respectively 22 or 46, and a bottom display device, respectively 24 or 48, said method including the step of automatically switching the top display device into the state in which it is transparent or into the state in which it is opaque and reflective, so that the display assembly passes alternately from a first mode displaying data via the top display device to a second mode displaying data via the bottom display device. The passer-by's eye will thus be drawn by this phenomenon, which should interest him in the product in question.

Within the meaning of the present invention, automatic switching means a method in which the watch is made to enter, for example by pressing on a push-button of said watch, an autonomous operating mode requiring no external action on the watch and in which the top display device is alternately switched into a state in which it is transparent or into a state in which it is opaque and reflective, so that the data displayed by the bottom display device appear then disappear cyclically to the observer in order to be replaced by the data displayed by the top display device.

When the display assembly is formed by an analogue display device 24 or 48 and a digital data display device 26, 28 or 50 arranged in front of the analogue display device which it covers at least partially, the display assembly is automatically and alternately passed from an analogue data display mode to a digital data display mode by alternately switching the digital display device into a state in which it is transparent and in which the analogue data display device is perfectly visible, or into a state in which it is opaque and reflective and in which it displays data by masking the analogue data display device.

Thus, upon seeing the watch automatically pass from an analogue data display mode to a digital data display mode and vice versa, the potential purchaser can immediately appreciate the considerable differences which distinguish this watch from conventional purely analogue or purely digital watches.

Figure 3:
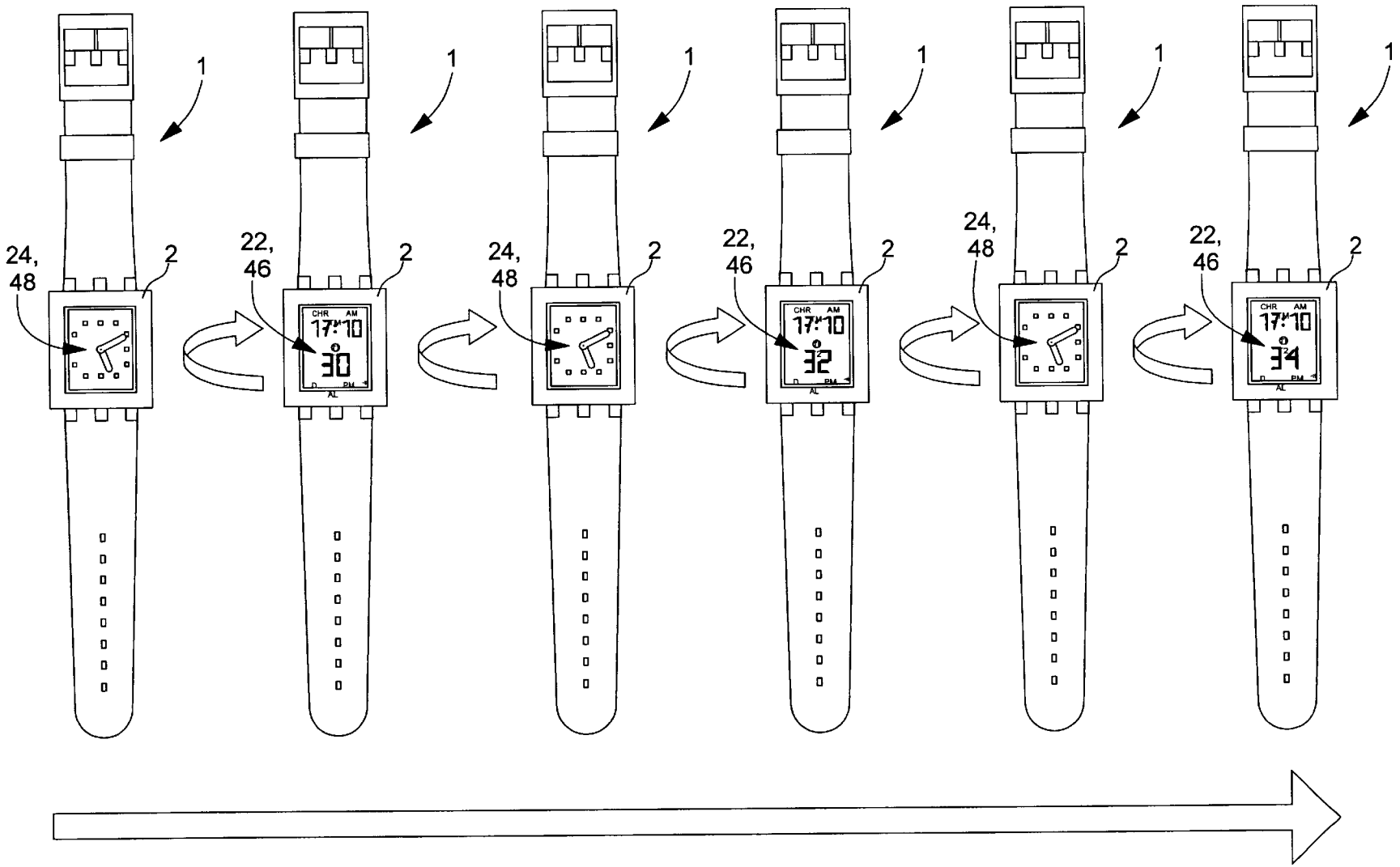
FIG. 3 is a succession of top views of a similar wristwatch to those shown in FIGS. 1 and 2, the top display device being alternately switched into a state in which it is transparent and where the data displayed by the analogue display device is visible, and in a state in which it displays a data item and in which it is reflective and opaque to mask the analogue display device.

FIG. 3 is a succession of top views of a similar wristwatch to those shown in FIGS. 1 and 2, the top display device 22 or 46 being alternately and automatically switched into a state in which it is transparent and where the time-related data displayed by the analogue display device, respectively 24 or 48 is visible, and into a state in which it displays a digital data item and in which it is reflective and opaque to mask the analogue display device. If the wristwatch shown in FIG. 3 is a watch of the type described with reference to FIG. 1, it includes a double structure formed of display cell 26 arranged above optical valve 28 which are both transparent in a first switching state, so as to make the data displayed by bottom display device 24 visible, whereas display cell 26 displays a data item and optical valve 28 is opaque and masks bottom display device 24 in a second switching state. Conversely, if the wristwatch of FIG. 3 is a watch of the type described with reference to FIG. 2, it includes a single display cell 50 which, as chosen, may be transparent in a first switching state to make the data displayed by bottom display device 48 visible, or display a data item and be opaque and reflective in a second switching state to mask the data displayed by bottom display device 48. The analogue and digital display sequences follow each other over time at a frequency of the order of 0.5 Hz for example, in the order represented by an arrow in FIG. 3.

Figure 4:
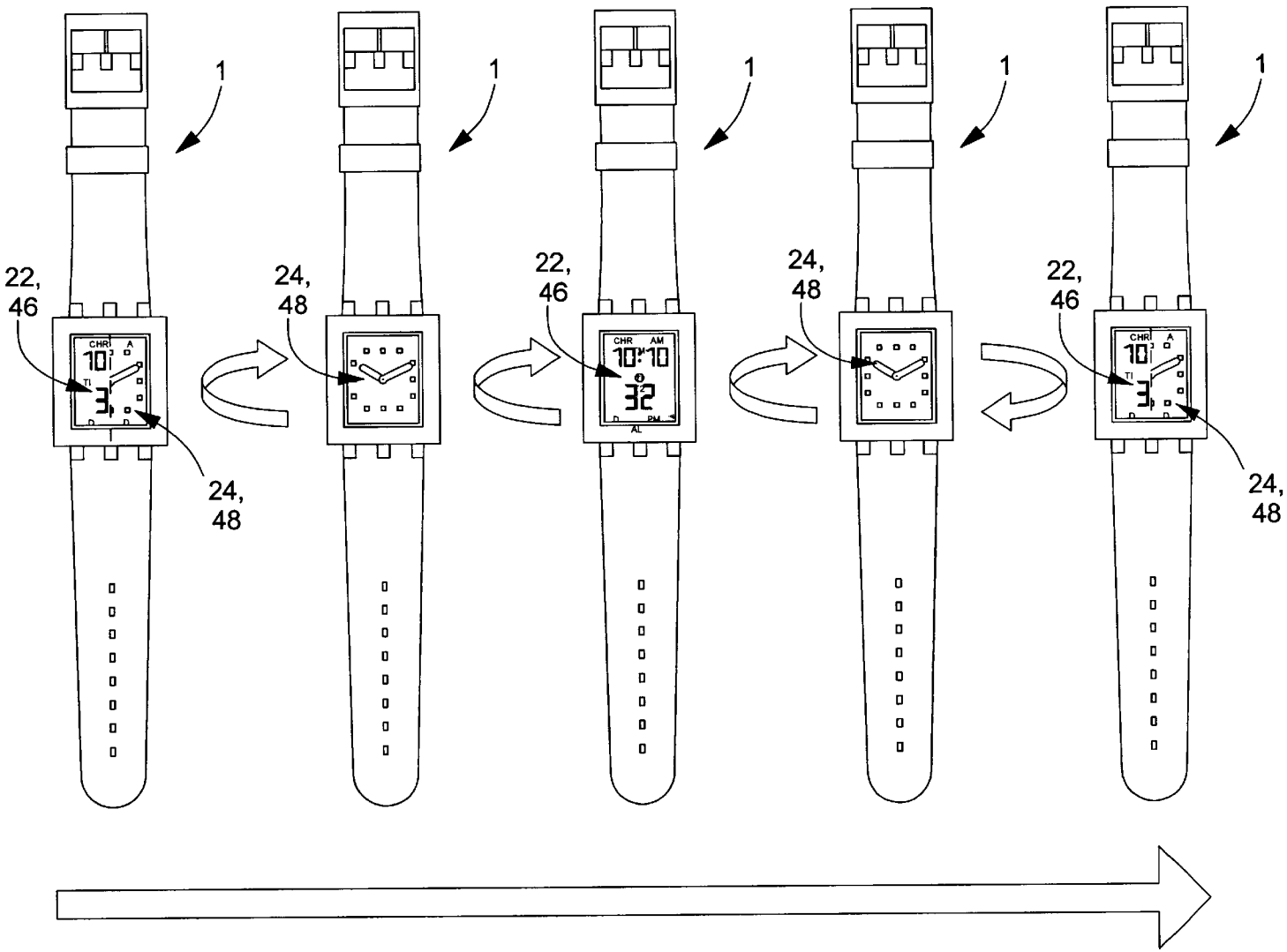
FIG. 4 is a succession of top views similar to those of FIG. 3 in which intermittently, both the digital display device and the analogue display device are simultaneously visible.

FIG. 4 is a succession of top views of a wristwatch similar to those of FIG. 3 in which one can see that digital display device 26, 28 or 50 and analogue display device 12, 14, 16 and 18 are intermittently visible simultaneously, only half, for example, of the digital display device being electrically controlled to display data, while the other half of said digital display device remains transparent so as to make the subjacent analogue time-related data display device visible. Such an operating mode may be activated by the vendor before placing the timepiece in the window or by the user himself if he should wish to give a demonstration to his companions of the extended functions of his watch. Preferably, the analogue and digital display sequences follow each other in time at a frequency of the order of 0.5 Hz which is a sufficiently fast frequency to attract the attention of the potential client examining the contents of a shop window, but also slow enough to allow the observer to appreciate the details of the analogue display and the digital display.

Figure 5:
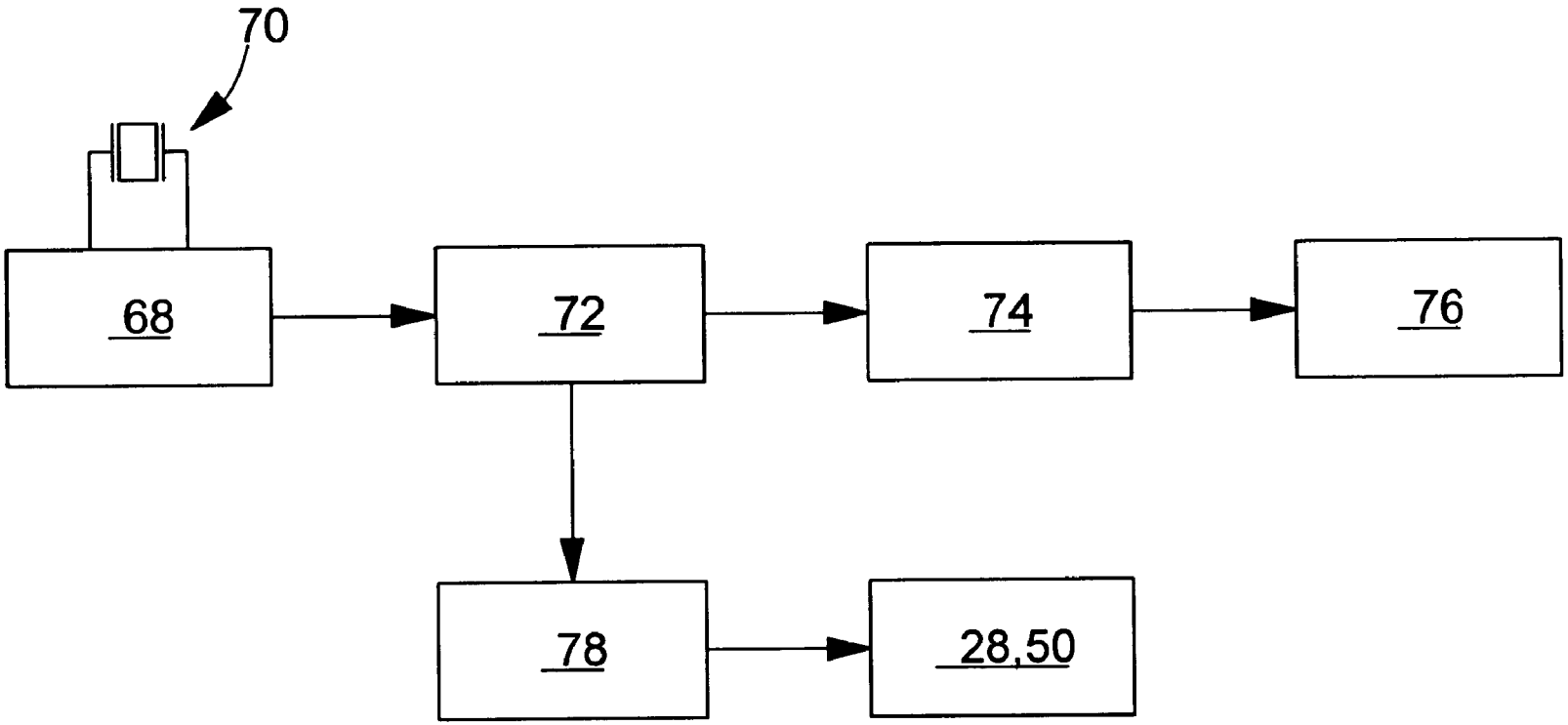
FIG. 5 is a schematic diagram of the electronic circuit necessary to implement the method according to the present invention.

FIG. 5 is a schematic diagram of the electronic circuit intended for implementing the method according to the present invention. This Figure shows an electronic time-keeping circuit 68 mounted across the terminals of a quartz oscillator 70. This time-keeping circuit 68 is conventionally associated, via a frequency divider circuit 72, for example with a drive device 74 for a motor 76 which supplies the mechanical power necessary to drive hands 12, 14 and 16 forming the analogue time-related data display bottom device 24 or 48. Frequency divider circuit 72 also supplies to control means 78 of top display device 22 or 46 a signal at the desired frequency, for example of 0.5 Hz, so that these control means 78 will apply a control voltage at the same frequency of 0.5 Hz to optical valve 28 or to display cell 50 to cause the latter to pass from a state in which they are transparent and allow bottom display device 24 or 48 to appear, to a state in which they are opaque and reflective to mask said bottom display device 24 or 48 and display alphanumerical type data.

It goes without saying that the invention is not limited to the embodiments which have just been described, and that modifications and variants may be envisaged without departing from the scope of the present invention. In particular, it may be envisaged that the wearer himself adjusts the switching frequency at which the top display device becomes alternately opaque to display data and mask the bottom display device, or transparent, thus allowing the bottom display device to appear.

What is claimed is:

1. A sequential control method for a display assembly including two superposed, respectively top and bottom, display devices, this display assembly being formed by an analogue data display device and a digital display device arranged in front of the analogue display device which it covers at least partially, the top display device including at least a liquid crystal display cell and being arranged so as to be transparent in a first state to make the bottom display device visible, and so as to display a data item and to be opaque and reflective and to mask at least partially the bottom display device in a second state, control means supplying a control voltage to cause the top display device to pass from the first state to the second state and vice versa, wherein the display assembly is made to enter an operating state in which the top display device automatically switches into the state in which it is transparent or into the state in which it is opaque and reflective, so that the display assembly passes alternately from an analogue data display mode to a digital data display mode.

2. The method according to claim 1, wherein the top display device and the bottom display device are automatically and alternately activated at a frequency of the order of 0.5 Hz.

* * * * *